US007818851B2

(12) United States Patent
Perrotta

(10) Patent No.: US 7,818,851 B2
(45) Date of Patent: Oct. 26, 2010

(54) STRAP LOCK

(76) Inventor: Chris Perrotta, 1425 Constellation Dr., Allen, TX (US) 75013

( * ) Notice: Subject to any disclaimer, the term of this patent is extended or adjusted under 35 U.S.C. 154(b) by 713 days.

(21) Appl. No.: 11/828,170

(22) Filed: Jul. 25, 2007

(65) Prior Publication Data

US 2009/0025529 A1 Jan. 29, 2009

(51) Int. Cl.
*A44B 11/00* (2006.01)
*G10G 5/00* (2006.01)
*G10D 3/00* (2006.01)

(52) U.S. Cl. ..... 24/701; 24/265 BC; 24/265 EC; 84/327

(58) Field of Classification Search ..... 24/265 EC, 24/265 BC, 265 R, 701; 84/327
See application file for complete search history.

(56) References Cited

U.S. PATENT DOCUMENTS 2,640,246 A * 6/1953 Shomber ..... 24/701
3,688,012 A 8/1972 Vettel
4,188,851 A 2/1980 Wolf
4,271,999 A 6/1981 Stravitz
4,901,900 A 2/1990 Goto
4,993,127 A 2/1991 Mechem et al.
6,032,339 A 3/2000 D'Addario
6,080,922 A 6/2000 Dimbath
6,169,238 B1 1/2001 Bolo, III
6,259,009 B1 7/2001 Bolo, III
D466,546 S 12/2002 Warden
6,590,145 B2 7/2003 Doiron
7,045,694 B2 5/2006 Yasunori
7,562,422 B2 * 7/2009 D'Addario et al. ..... 24/701
2002/0104425 A1 8/2002 Warden
2005/0284282 A1 12/2005 D'Addario et al.

OTHER PUBLICATIONS

International Search Report and Written Opinion of ISA/US for International Application No. PCT/US 08/08957.

* cited by examiner

*Primary Examiner*—Robert J Sandy
(74) *Attorney, Agent, or Firm*—Klemchuk Kubasta LLP; Keith E. Taber

(57) ABSTRACT

A strap lock is provided. The strap lock includes a sleeve, a slider and a spring. The slider fits within the sleeve and moves from a locked position to an unlocked position. The spring biases the slider into a locked position. The sleeve may be attached to a strap end having a keyhole such that the slider covers a portion of the keyhole when in a locked position and uncovers the keyhole when in an unlocked position.

18 Claims, 8 Drawing Sheets

STRAP LOCK

BACKGROUND

1. Field of the Invention

The present invention relates generally to straps used to support items such as guitars and in particular to a lock for securing the strap to the item when in use.

2. Description of Related Art

Within the strap industry, and in particular within the guitar strap market, a convention has formed around the use of a button on the item to be supported by the strap and a keyhole on the end of the strap that engages the button. The use of a button and keyhole arrangement is nearly universal among guitar straps and is also widely used in conjunction with other items.

With increased movement of the item being supported by the strap the keyhole can tend to expand and occasionally the button may pull through the keyhole. This is particularly disconcerting when playing a guitar as the now unsupported end of the guitar may fall to the floor or stage causing damage.

Attempts to prevent this sort of damage have centered around either replacing the button and keyhole with a more secure fastener or supplementing the button and keyhole. No solution to date has found market success. Each has had its own drawbacks, but in general they have been too bulky to appeal to a musician playing an expensive guitar. Some require modification of the button. Others require the addition of a mechanism that is too bulky to fit in a fitted case with the instrument. Still others create a stiffened strap end that is not natural or does not fit in a fitted case with the instrument.

A need exists, therefore, for an improved system that would secure a strap to an instrument without requiring modification to the instrument or how the instrument is played or stored.

All references cited herein are incorporated by reference to the maximum extent allowable by law. To the extent a reference may not be fully incorporated herein, it is incorporated by reference for background purposes and indicative of the knowledge of one of ordinary skill in the art.

BRIEF SUMMARY OF THE INVENTION

The problems presented in strap art are solved by the systems and methods of the present invention. In accordance with one embodiment of the present invention, a strap lock is provided having a sleeve, slider and spring that work to secure a strap end to the button of an instrument. The slider fits within the sleeve and moves from a locked position to an unlocked position. The spring biases the slider into a locked position. The sleeve may be attached to a strap end having a keyhole such that the slider covers a portion of the keyhole when in a locked position and uncovers the keyhole when in an unlocked position.

Other objects, features, and advantages of the present invention will become apparent with reference to the drawings and detailed description that follow.

DETAILED DESCRIPTION OF THE PREFERRED EMBODIMENT

All references cited herein are incorporated by reference to the maximum extent allowable by law. To the extent a reference may not be fully incorporated herein, it is incorporated by reference for background purposes and indicative of the knowledge of one of ordinary skill in the art.

In the following detailed description of the preferred embodiments, reference is made to the accompanying drawings, which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
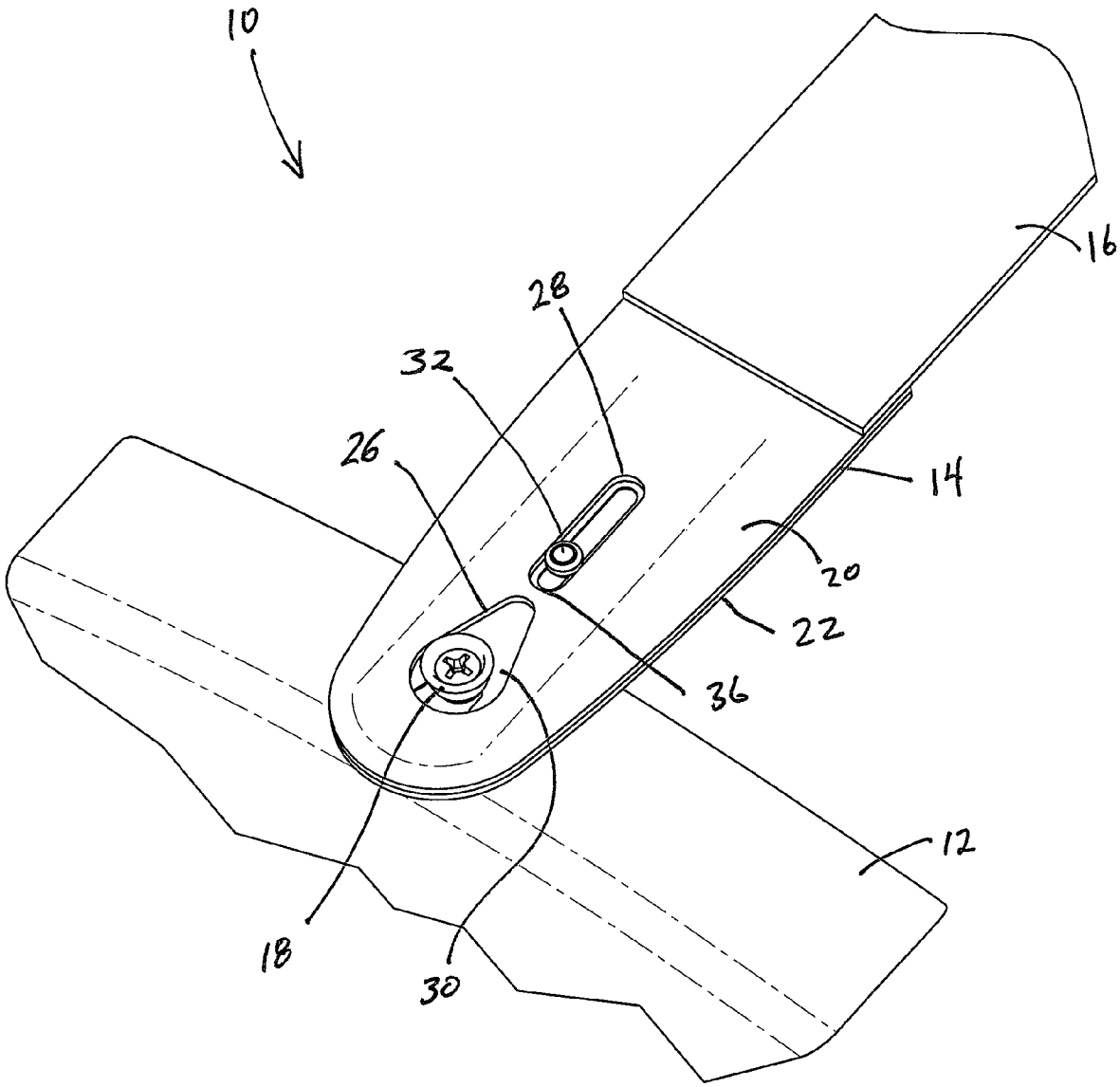
FIG. 1 is a view of a strap lock engaged on an instrument.

Referring now to FIG. 1, a strap lock 10 is shown engaged on an instrument 12. Strap lock 10 is secured within strap end 14 of strap 16. Strap lock 10 engages button 18 on instrument 12. Button 18 is typically screwed into or otherwise fixed to instrument 12. Strap end 14 as shown has a front layer 20 and a back layer 22. In this embodiment strap lock 10 is secured between front layer 20 and back layer 22. This placement provides protection for the strap lock 10 while also reducing the visibility of strap lock 10, but other configurations are possible and alternatives are discussed below. Button 18 is shown extending through a keyhole 24 in back layer 22, although the keyhole 24 is better seen in FIG. 3. Front layer 20 is shown with a large hole 26 through which parts of strap lock 10 can be viewed along with button 18. Front layer 20 also has a tab hole 28 through which another portion of the strap lock 10 is visible.

Continuing with FIG. 1 certain aspects of a strap lock 10 are visible from this view. Strap Lock 10 has a slider 30 that engages button 18 and covers a portion of keyhole 24. A tab 32 is attached to the slider 30 and is visible through the tab hole 28 in front layer 20 of strap end 14.

Strap end 14 is shown attached to the end of strap 16 directly, but many methods and mechanisms are well known for attaching a strap end 14 to a strap 16. Also, while the embodiment shows a large hole 26 sized not to contact button 18, large hole 26 may be smaller or larger and may be shaped differently. Large hole 26 may be identical or similar to keyhole 24. Each of these configurations has advantages functionally and aesthetically. Large hole 26 as shown allows for visual confirmation of lock 10 status and reduces the chances that the front layer 20 may interfere in the operation of lock 10. Large hole 26 when formed as a keyhole similar to keyhole 24 may be more aesthetically pleasing to a user who wants to minimize the visual impact of using lock 10.

Figure 2:
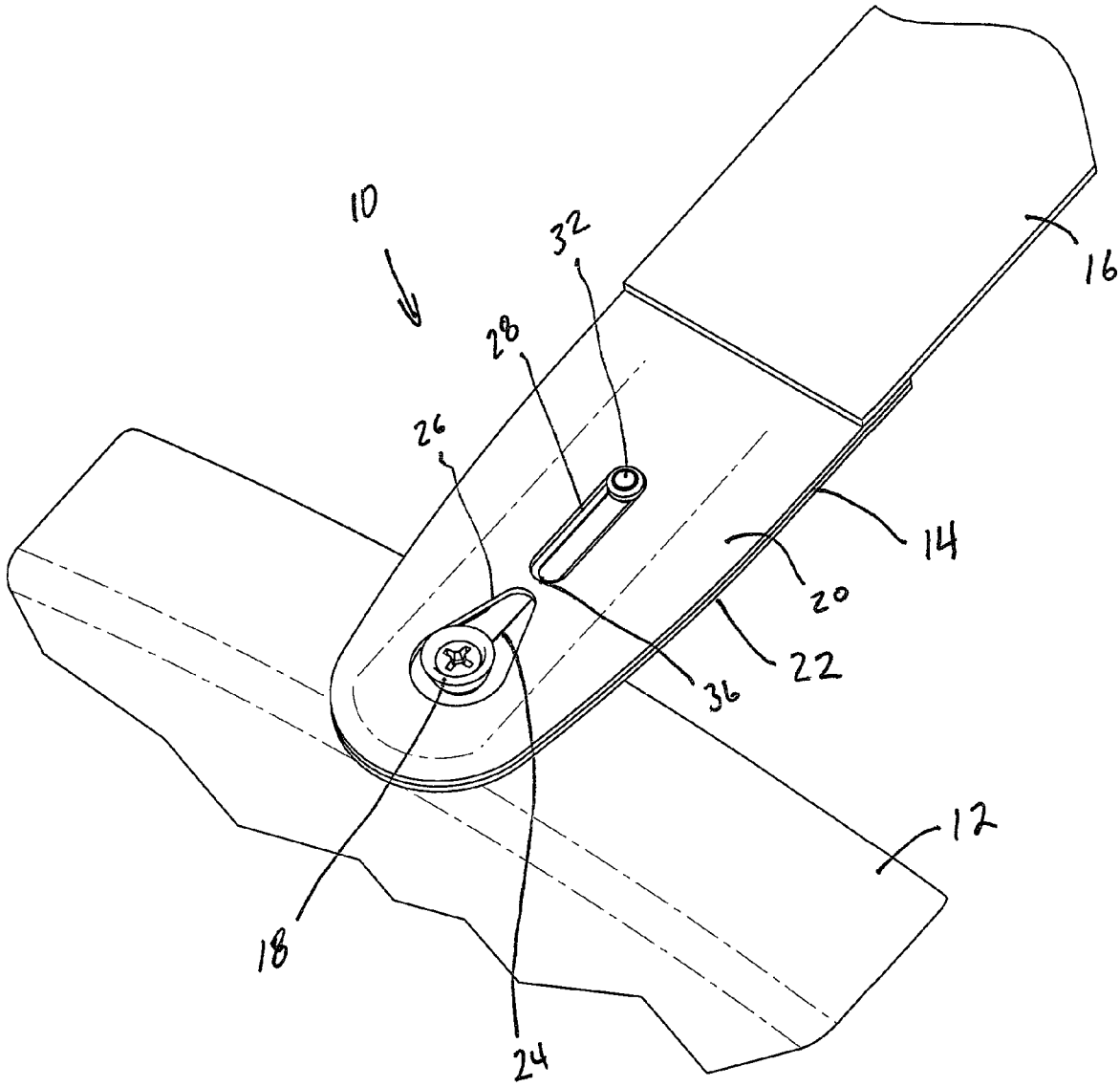
FIG. 2 is a view of the strap lock in FIG. 1 in an unlocked position on an instrument.

Turning now to FIG. 2, the strap lock 10 of FIG. 1 is shown in an unlocked position on an instrument 12. Tab 32 is shown slid to an end of tab hole 28 and slider 30 is not visible as it has been retracted into strap lock 10 as is better understood by reference to FIG. 5, below. FIG. 2 does show back layer 22 with keyhole 24 through which button 18 is inserted.

Figure 3:
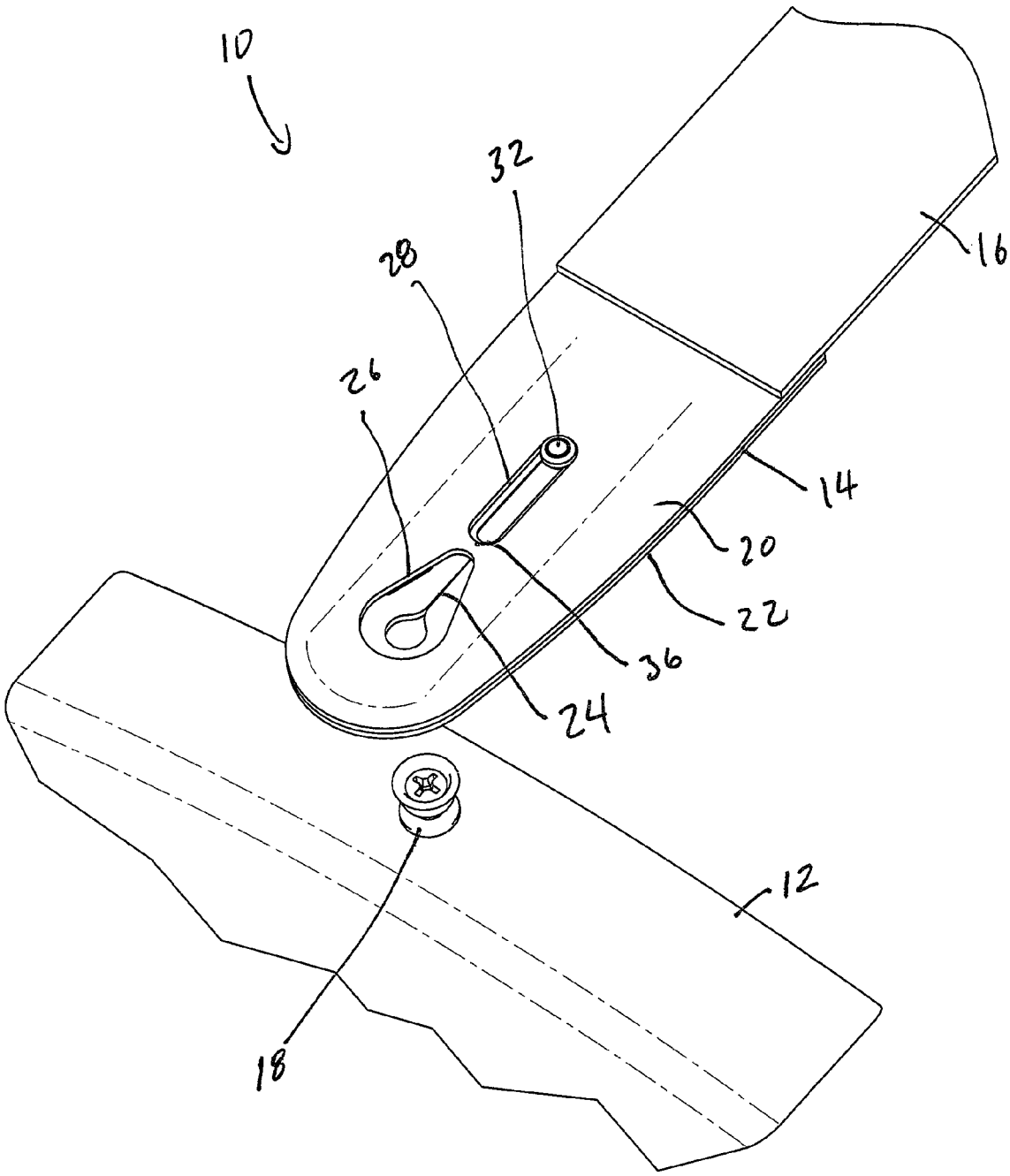
FIG. 3 is a view of the strap lock of FIG. 1 removed from the instrument and in an unlocked position.

Continuing to FIG. 3, the strap lock 10 of FIGS. 1 and 2 is shown removed from the instrument 12 and in an unlocked position. Keyhole 24 and button 18 on instrument 12 are clearly visible in this view.

Figure 4:
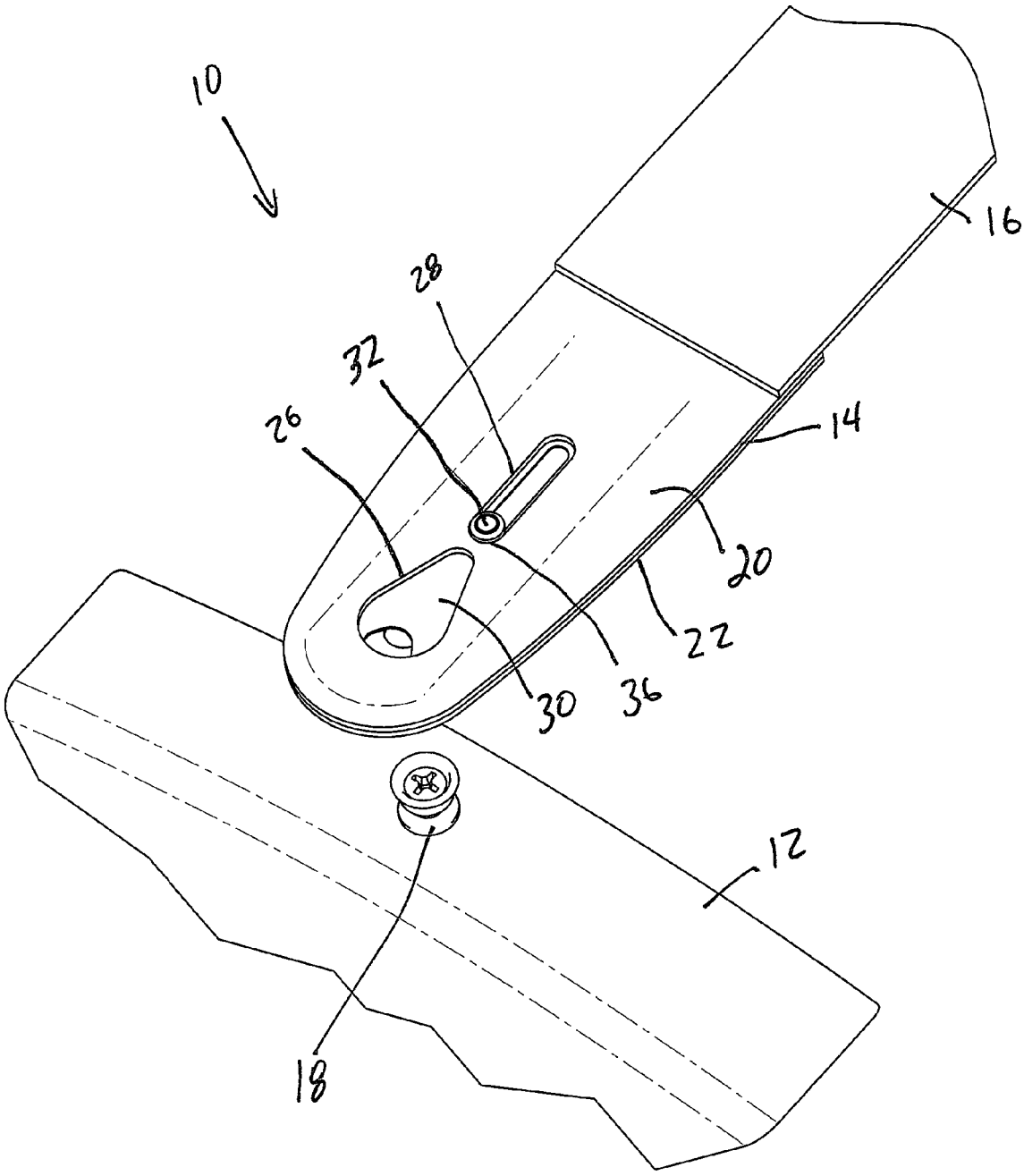
FIG. 4 is a view of the strap lock of FIG. 1 removed from the instrument and in a locked position.

In FIG. 4 the strap lock 10 of FIGS. 1, 2, & 3 is shown removed from the instrument 12 and in a locked position, thus exposing slider 30 in large hole 26.

The series of FIGS. 1-4 combined clearly show several of the features of the strap lock 10. In particular, the ease of use is evident from the series as tab 32 is shown to easily control slider 30 from a locked position to an unlocked position and vice versa. In use spring 58 will bias tab 32 to the locked position such that tab 32 is mainly used to move the slider 30 from the locked position to the unlocked position and spring 58 will return the slider from the unlocked position to the locked position. Also shown is that slider 30 has a range of motion to provide coverage over a portion of keyhole 24 when in the locked position while leaving keyhole 24 completely uncovered while in an unlocked position. Also shown in the series of FIGS. 1-4 is the feature of overtravel 34 of slider 30 and tab 32. Overtravel 34 is the difference in the locked position of FIG. 1 where slider 30 abuts button 18 and the locked position of FIG. 4 where slider 30 travels slightly beyond where it would abut button 18 to the point where tab 32 abuts the distal end 36 of tab hole 28. Because of overtravel 34, even though there may be wear in back layer 22 around keyhole 24, slider 30 will always reach to abut button 18.

FIGS. 1-4 show lock 10 placed on instrument 12 such that tab 32 faces out from instrument 12. This arrangement allows easy visual confirmation that slider 30 is engaged with button 18. Where the existence of strap lock 10 is to be concealed the strap end may be rotated 180 degrees such that tab 32 faces instrument 12. This arrangement would hide strap lock 10 and with a low profile tab 32 or a non-marring cover over tab 32 there would be no damage to instrument 12.

Figure 5:
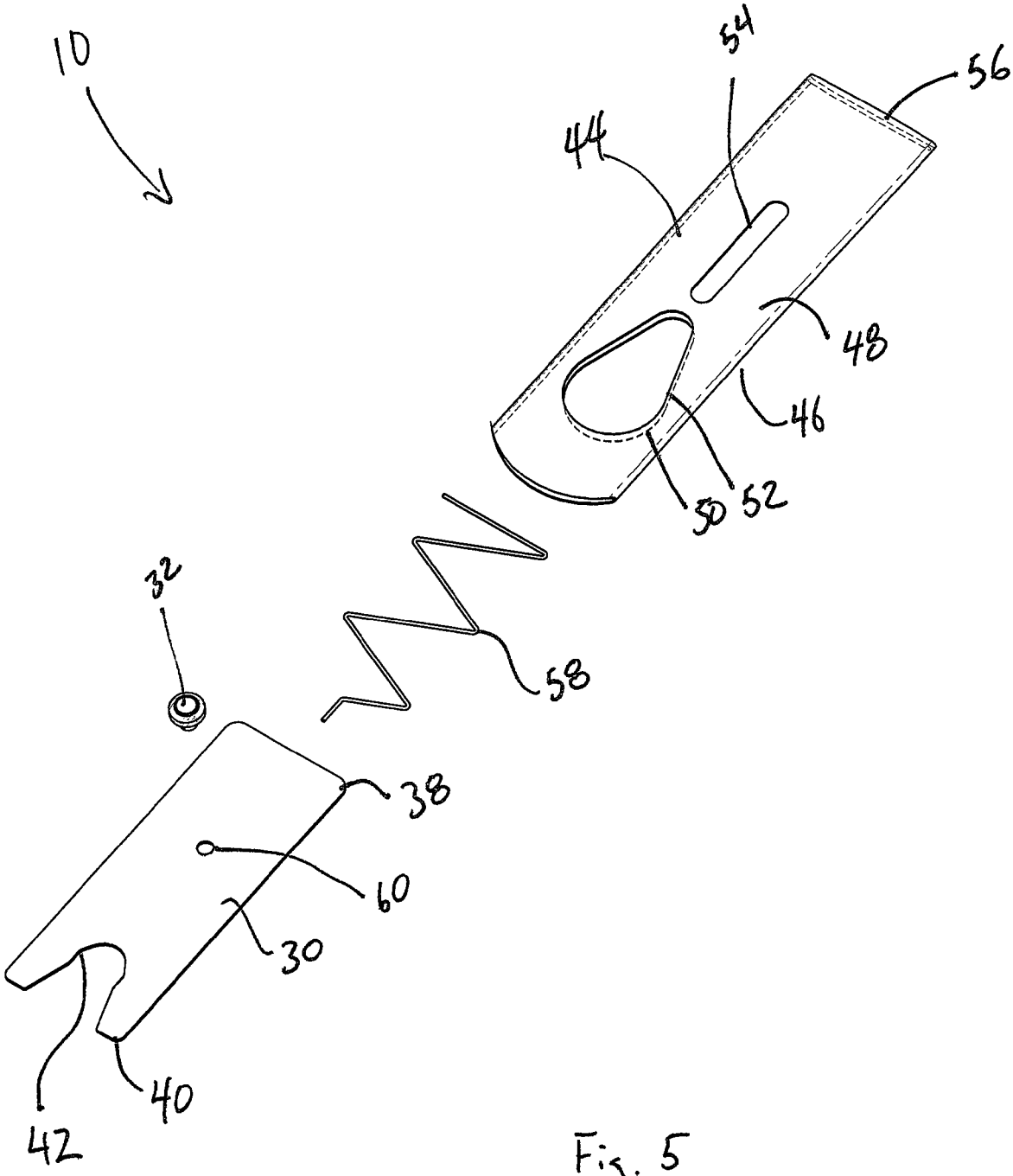
FIG. 5 is an exploded view of the strap lock in FIG. 1.

Turning now to FIG. 5, an exploded view of the strap lock 10 of FIGS. 1-4, shows the operable parts of strap lock 10. Slider 30 is shown with tab 32. Slider 30 has a back end 38 that extends beyond tab 32 and a notched end 40 with a notch 42 that abuts button 18. Slider 30 is sized to fit within sleeve 44. Sleeve 44 has a bottom side 46 and a top side 48. Bottom side 46 has a bottom hole 50 while top side 48 has a top hole 52 and a tab slot 54. Bottom hole 50 and top hole 52 are shown identical in shape and similar in shape to large hole 26. The shape of holes 50, 52, and 26 is chosen to not interfere with the insertion and removal of button 18 through keyhole 24 and therefore may change depending on the shape of button 18 or keyhole 24. Tab slot 54 is shaped to allow tab 32 to travel from an unlocked position to a locked position as shown in FIGS. 1-4. Tab slot 54 should typically align with tab hole 28. Sleeve 44 has a sealed end 56. Spring 58 is positioned to abut sealed end 56 and extends to connect to slider 30 such that spring 58 provides a bias to slider 30 pushing slider 30 into a locked position when tab 32 is released. In the embodiment shown, slider 30 has a slider hole 60 through which tab 32 extends to engage spring 58. Tab 32 is thereby secured in slider hole 60 by spring 58.

Back end 38 of slider 30 extends beyond tab 32 to cover tab hole 52 throughout the full range motion such that spring 58 is not exposed to external debris through tab hole 52. Slider 30 may not include a back end 38 that extends beyond tab 32, but this would either leave spring 58 exposed to debris through tab hole 52 or require a separate element to cover tab hole 52 throughout the full range of motion.

Notch 42 on slider 30 is shaped to engage a range of button 18 sizes and is specifically shaped to abut the button 18 about a significant portion of its circumference. Notch 42 is shaped to abut button 18 on as many surfaces as are possible and still allow the button 18 to slide in and out of the notch 42. Notch 42 is deep enough such that if the slider 30 is bent the extended portions of slider 30 on either side of notch 42 are secured and does not easily pull out of engagement with button 18. A shallower notch 42 may be used to make a smaller lock 10, but will more easily bend out of engagement with the button 18 and may prove not to secure as well.

Tab 32 could also be molded as a part of slider 30 and spring 58 could be attached by alternative means known in the art, such as a separate mounting block molded into the slider.

Spring 58 is shown in a "zig-zag" formation as this formation has proven to provide adequate pressure on slider 30 when the sleeve 44 and slider 30 are in-plane, as shown, and when the lock 10 is deformed out-of-plane, as can happen in use. Furthermore, spring 58 provides sufficient force to track the button 18 as it moves within strap end 14. In use, button 18 may push back on slider 30 as it moves within strap end 14. Slider 30 must stay in close contact with button 18 even as it moves within strap end 14. This requires spring 58 to provide sufficient force to maintain button 18 within notch 42 throughout the range of movement and when lock 10 is deformed out of plane. Spring 58 may be a round spring or other spring designs that achieve these goals or functions similarly.

Sleeve 44 may be made from tubular material that is cut and sealed to form sleeve 44 or it may be made from sheet material folded to form sleeve 44 or two sheets of material sealed together to form sleeve 44. The process of formation determines primarily the cost of production and should not have significant effects on the operation of the sleeve 44.

Figure 6:
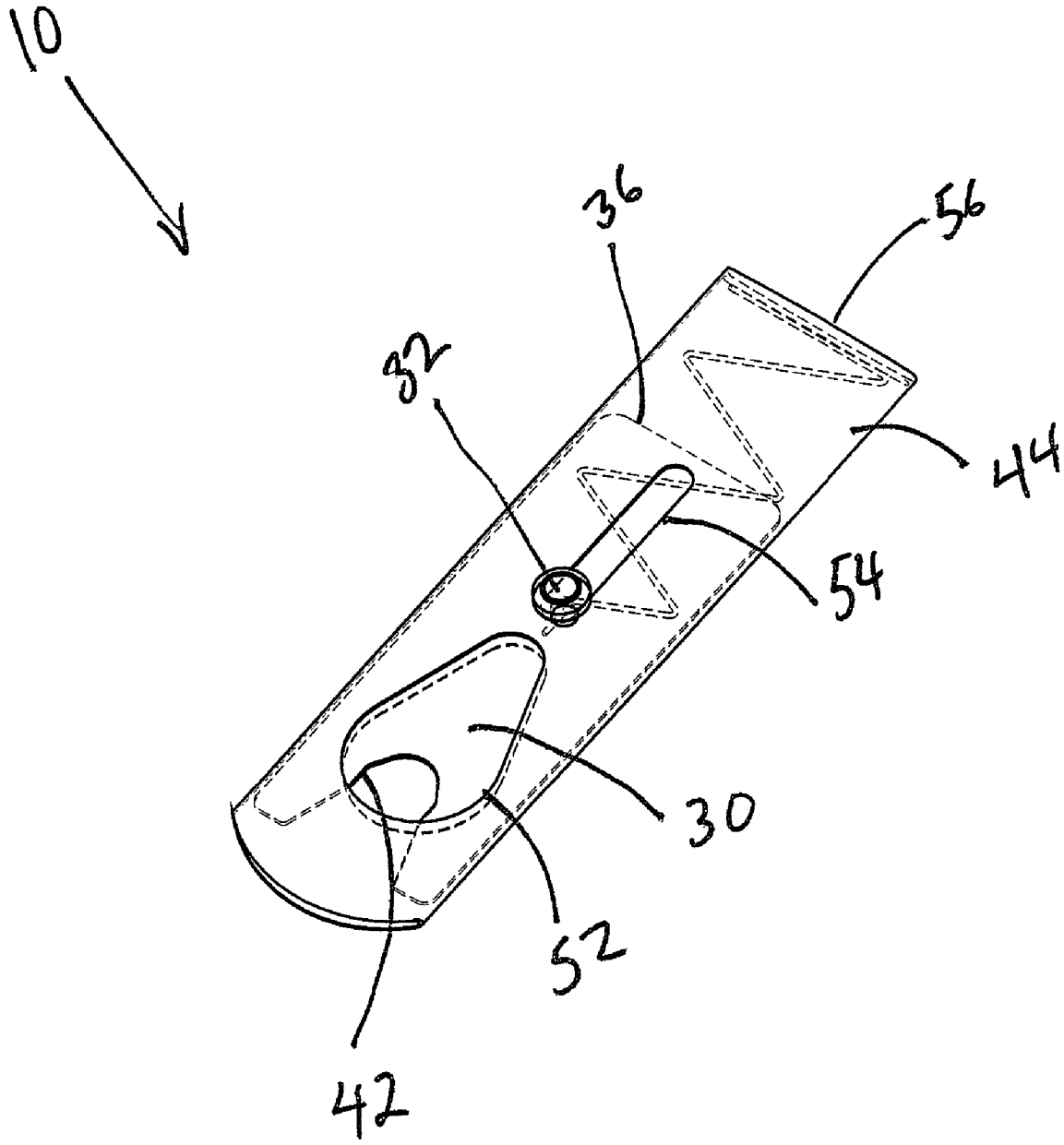
FIG. 6 is an assembled view of the strap lock of FIG. 5.

Turning now to FIG. 6, strap lock 10 of FIG. 5 can be seen assembled. Sleeve 44 in the example has been constructed of polypropylene while slider 30 has been constructed of polycarbonate and spring 58 uses spring steel. Theses materials, when used in the shown strap lock 10, provide a toughness, smooth operation and flexibility. For example, the embodiments shown, when made with the materials listed, perform through a wide range of deformation out of plane and can return to function after a catastrophic deformation out of plane. Other materials may be suitable, such that they provide similar properties in relation to one another. For example, slider 30 may be made form a variety of other plastics or even spring steel and spring 58 may be molded or cut from plastic. Furthermore, spring 58 and slider 30 may be molded or cut from a single piece of material, instead of being formed of two parts.

Figure 7:
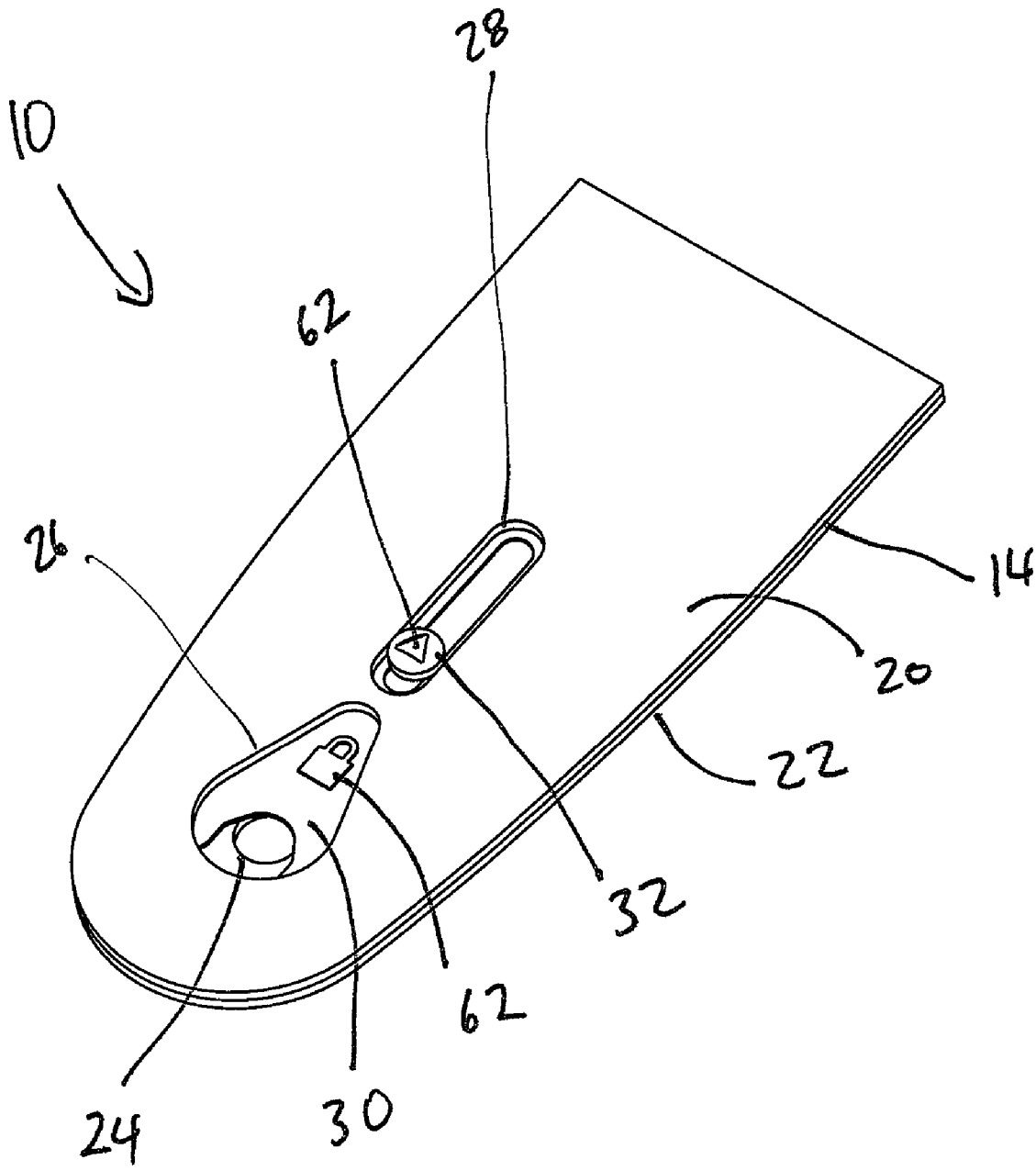
FIG. 7 is a view of a strap lock with indicia confirming lock status.

Turning to FIG. 7, a strap lock 10 is shown with indicia 62 on slider 30 confirming that strap lock 10 is in a locked position. As tab 32 moves slider 30 into an unlocked position indicia 62 is hidden within sleeve 44. Indicia 62 may be any symbol, such as the lock shown or even a logo associated with a brand and may be in a bright color to increase visibility. Indicia 62 may even be produced with an ink that glows in darkened environments or when exposed to certain lighting, such as black lights or some other light source. Further, tab indicia 64 may be provided as shown to make tab 32 easier to find and may also be produced in a variety of inks or dies to obtain the desired effect.

Figure 8:
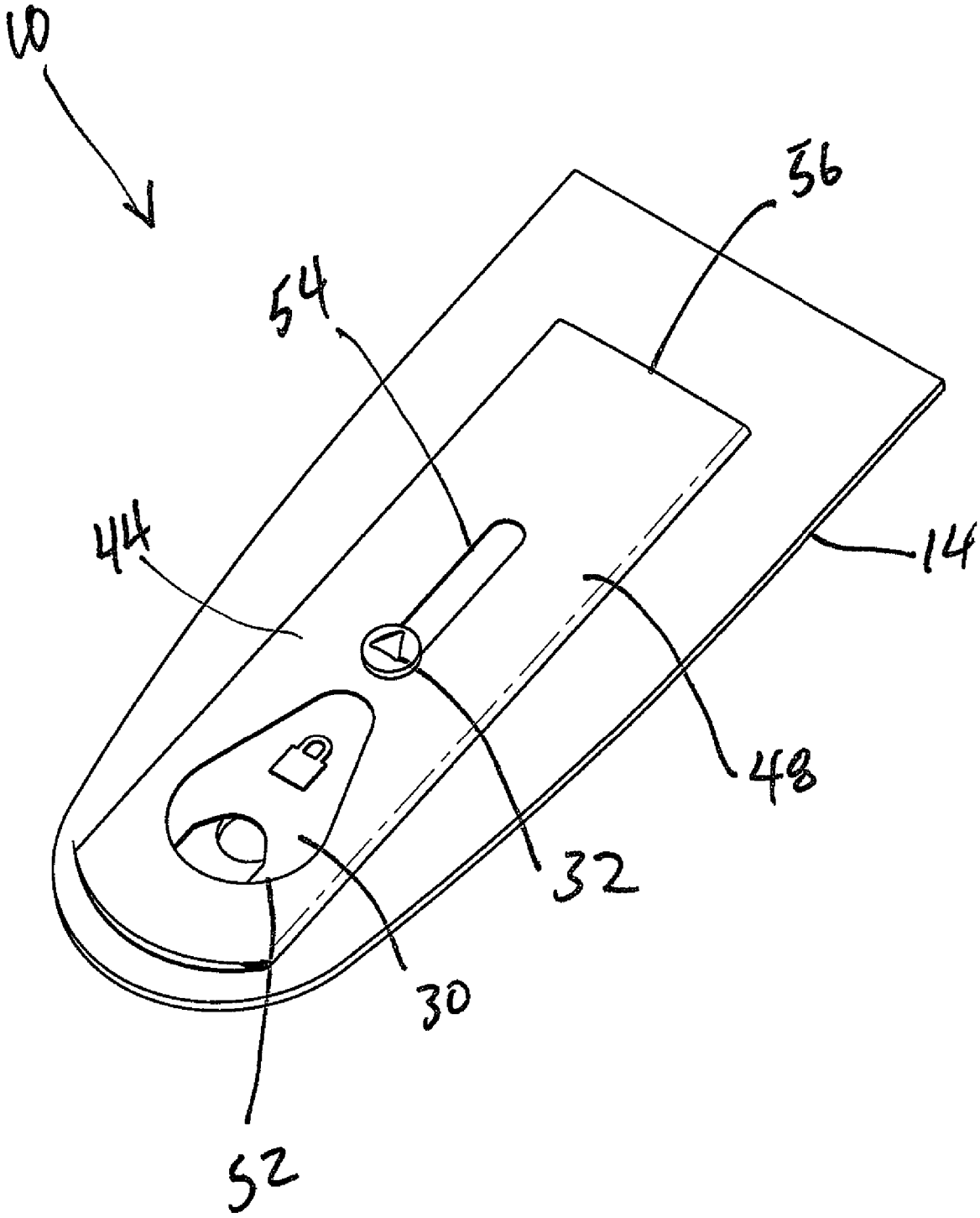
FIG. 8 is a view of a lock strap positioned on the surface of a strap end.

Turning to FIG. 8, a strap lock 10 is shown positioned on the surface of a strap end 14 instead of between front layer 20 and back layer 22. Sleeve 44 is secured to strap end 14 by a suitable means depending on the materials and environment. Sleeve 44 may be attached by physical bonding (such as sewing, riveting, buttoning, or stapling), adhesive bonding, thermal bonding, hook and loop fasteners, or any other bond known in the art.

Even though many of the examples discussed herein are applications of the present invention to guitar straps, the present invention also can be applied to other types of instrument straps, including but not limited to other musical instruments, scientific instruments, electronic instruments or photographic instruments.

It should be apparent from the foregoing that an invention having significant advantages has been provided. While the invention is shown in only a few of its forms, it is not just limited but is susceptible to various changes and modifications without departing from the spirit thereof.

I claim:

1. A strap lock comprising:

a sleeve comprising:

a bottom side having a bottom hole;

a top side having a top hole aligned with the bottom hole and a tab slot having a width;

the top side and the bottom side being connected along three sides to form the sleeve with an open end;

a slider comprising:

a generally flat body having a notch at one end and a hole;

a tab having a first end that is larger than the width of the tab slot and positioned on the outside of the sleeve and a second end that is smaller than the width of the tab slot and extends through the tab slot and through the hole in the slider; and a spring with one end engaging the tab to secure it in the hole and the other end engaging the sleeve to bias the slider towards the opening of the sleeve.

2. The strap lock according to claim 1 wherein:

the sleeve is secured to the end of a strap having a keyhole such that the notch is positioned adjacent the keyhole.

3. The strap lock according to claim 1 wherein:

the sleeve is secured within the end of a strap having a keyhole such that the notch is positioned adjacent the keyhole.

4. The strap lock according to claim 1 wherein:

the sleeve is secured to the end of a strap having a keyhole such that the notch is positioned adjacent the keyhole and the tab slot allows for travel of the notch past the keyhole.

5. The strap lock according to claim 1 wherein:

the sleeve and the slider are formed of plastic materials to allow deformation of the strap lock without damaging the strap lock.

6. The strap lock according to claim 1 wherein:

the sleeve is secured to the end of a strap having a keyhole such that the notch is positioned adjacent the keyhole and the slider covers the keyhole when in an engaged position and uncovers the keyhole when in a disengaged position.

7. A strap lock system comprising:

a sleeve comprising:

a bottom side having a bottom hole;

a top side having a top hole aligned with the bottom hole and a tab slot having a width;

the top side and the bottom side being connected along three sides to form the sleeve with an open end;

a slider comprising:

a generally flat body having a notch at one end and a hole;

a tab having a first end that is larger than the width of the tab slot and positioned on the outside of the sleeve and a second end that is smaller than the width of the tab slot and extends through the tab slot and through the hole in the slider;

a spring with one end engaging the tab to secure it in the hole and the other end engaging the sleeve to bias the slider towards the opening of the sleeve;

a strap end attached to the sleeve; the strap end having a keyhole aligned with the bottom hole and the top hole such that the slider travels from an engaged position where the slider covers the majority of the keyhole to disengaged position where the slider covers almost none of the keyhole.

8. The system according to claim 7 wherein:

the strap end comprises a front layer and a back layer and the sleeve is positioned between the front layer and the back layer.

9. The system according to claim 8 wherein:

the front layer has a large hole aligned with the top hole and the bottom layer has a keyhole aligned with the bottom hole.

10. The system according to claim 9 wherein:

the slider displays indicia when the slider is in the engaged position that is not visible when the slider is in the disengaged position.

11. The system according to claim 7 wherein:

the strap has a exterior surface and the sleeve is attached to the exterior surface.

12. The system according to claim 11 wherein:

the slider displays indicia when the slider is in the engaged position that is not visible when the slider is in the disengaged position.

13. A strap lock comprising:

a sleeve comprising:

a bottom side having a bottom hole;

a top side having a top hole aligned with the bottom hole and a tab slot having a width;

the top side and the bottom side being connected along three sides to form the sleeve with an open end;

a slider comprising:

a generally flat body having a notch at one end;

a tab having a first end that is larger than the width of the tab slot and positioned on the outside of the sleeve and a second end that is smaller than the width of the tab slot and extends through the tab slot and is secured to the slider; and a spring with one end engaging the tab to secure it in the hole and the other end engaging the sleeve to bias the slider towards the opening of the sleeve.

14. The strap lock according to claim 13 wherein:

the sleeve is secured to the end of a strap having a keyhole such that the notch is positioned adjacent the keyhole.

15. The strap lock according to claim 13 wherein:

the sleeve is secured within the end of a strap having a keyhole such that the notch is positioned adjacent the keyhole.

16. The strap lock according to claim 13 wherein:

the sleeve is secured to the end of a strap having a keyhole such that the notch is positioned adjacent the keyhole and the tab slot allows for travel of the notch past the keyhole.

17. The strap lock according to claim 13 wherein:

the sleeve and the slider are formed of plastic materials to allow deformation of the strap lock without damaging the strap lock.

18. The strap lock according to claim 13 wherein:

the sleeve is secured to the end of a strap having a keyhole such that the notch is positioned adjacent the keyhole and the slider covers the keyhole when in an engaged position and uncovers the keyhole when in a disengaged position.

* * * * *